US006032506A

United States Patent [19]

Kergen

[11] Patent Number: 6,032,506

[45] Date of Patent: Mar. 7, 2000

[54] IMPROVMENT TO THE BLANK HOLDER FORCE REGULATING SYSTEM IN A PRESS

[75] Inventor: Richard Kergen, Fexhe-le-Haut-Clocher, Belgium

[73] Assignees: S.C. Recherche et Developpement Groupe; Cockerill Sambre Campus Universitaire du Sart-Tilman

[21] Appl. No.: 09/011,243

[22] PCT Filed: May 28, 1997

[86] PCT No.: PCT/BE97/00063

§ 371 Date: Aug. 17, 1998

§ 102(e) Date: Aug. 17, 1998

[87] PCT Pub. No.: WO97/46337

PCT Pub. Date: Dec. 11, 1997

[30] Foreign Application Priority Data

May 30, 1996 [BE] Belgium ..... 9600485

[51] Int. Cl.[7] ..... B21D 24/08

[52] U.S. Cl. ..... 72/351; 72/453.13

[58] Field of Search ..... 72/350, 351, 453.06, 72/453.08, 453.13

[56] References Cited

U.S. PATENT DOCUMENTS

| | | | |
|---|---|---|---|
| 1,970,134 | 8/1934 | Ferris | 72/358 |
| 4,036,056 | 7/1977 | Saunders | 72/350 |
| 4,635,466 | 1/1987 | Seki et al. | 72/351 |
| 4,745,792 | 5/1988 | Story et al. | 72/351 |
| 5,623,848 | 4/1997 | Kirii | 72/351 |

FOREIGN PATENT DOCUMENTS

| | | | |
|---|---|---|---|
| 0 173 184 | 3/1986 | Germany | 72/351 |
| 3-71932 | 3/1991 | Japan | 72/351 |

*Primary Examiner*—Lowell A. Larson
*Attorney, Agent, or Firm*—Charles F. Meroni, Jr.; Meroni & Meroni

[57] ABSTRACT

A stamping press comprising a blank-holder force-regulating system using fluid-operated compensating cylinders (5, 7). The variation in the force in the blank-holder pressure-regulating areas is thus compensated so as to maintain a predetermined constant pressure in the conventional blank-holder area. This pressure in the conventional blank-holder area can, by virtue of the invention, according to certain alternative embodiments, also be made to vary.

14 Claims, 3 Drawing Sheets

IMPROVMENT TO THE BLANK HOLDER FORCE REGULATING SYSTEM IN A PRESS

The present invention relates to the field of stamping tools working on a hydraulic or mechanical press. It relates more particularly to the blank-holder force-regulating system in a stamping press.

A stamping press essentially comprises a table to which a die with an impression is fixed, the profile of which is that of the external surface of the component to be stamped, a blank holder serving to fix the sheet blank to be stamped, and a punch fixed to the ram of the press, this punch having a complementary profile to that of the impression of the die. When the punch exerts pressure on a blank placed over the die, it deforms the blank in the gap between the die and the punch.

The blank holder exerts a clamping pressure on the faces of the blank for the purpose of preventing the sheet wrinkling due to the shrinkage effect. The clamping pressure exerted by the blank holder may furthermore serve to create a high tensile stress in the skirt of stampings in the case of tapered stampings, or for setting up, by drawing on the punch for example.

European Patent No. 0,475,923 discloses a system which allows the blank-holder force to be rapidly varied and essentially to be regulated automatically on the basis of significant parameters of the stamping process.

When this system is used on a cushion of a hydraulic or mechanical press, the cushion force is chosen to be greater than the maximum blank-holder force exerted in the context of regulation and this force is exerted against thrust bearings which bear on that part of the tool which is connected to the moveable ram of the press. The force exerted by the cushion therefore serves in this case only to close the tooling, the effective, blank-holder pressure being exerted by small cylinders placed in the tooling. However, in industrial practice, there are situations in which it is not necessary to use the blank-holder force-regulating system over the entire area of the blank holder—a constant blank-holder pressure may be applied over a major area of the blank holder, as in conventional tools (this area being hereinafter called the conventional blank-holder area)—and a variable blank-holder pressure may be applied in one or more specific areas only, these being hereinafter called the blank-holder pressure-regulating areas. The present invention relates to these industrial situations.

To achieve this objective, the invention provides a blank-holder force-regulating system in which the variation in the force in the blank-holder pressure-regulating areas is compensated so as to maintain a predetermined constant pressure in the conventional blank-holder area. This pressure in the conventional blank-holder area can, by virtue of the present invention, according to certain alternative embodiments, also be made to vary.

The blank-holder force-regulating system according to the invention is defined in the claims.

The invention and an illustrative embodiment are described in greater detail below with the aid of the appended drawings.

Figure 1:
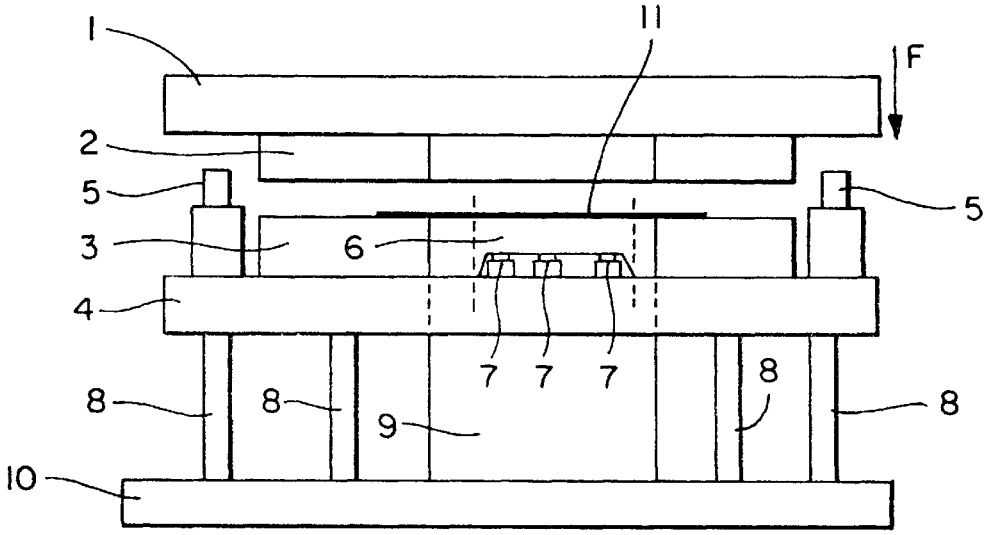
FIG. 1 represents a front view of a typical stamping press in which the invention is incorporated, the press being open, before stamping.
Figure 2:
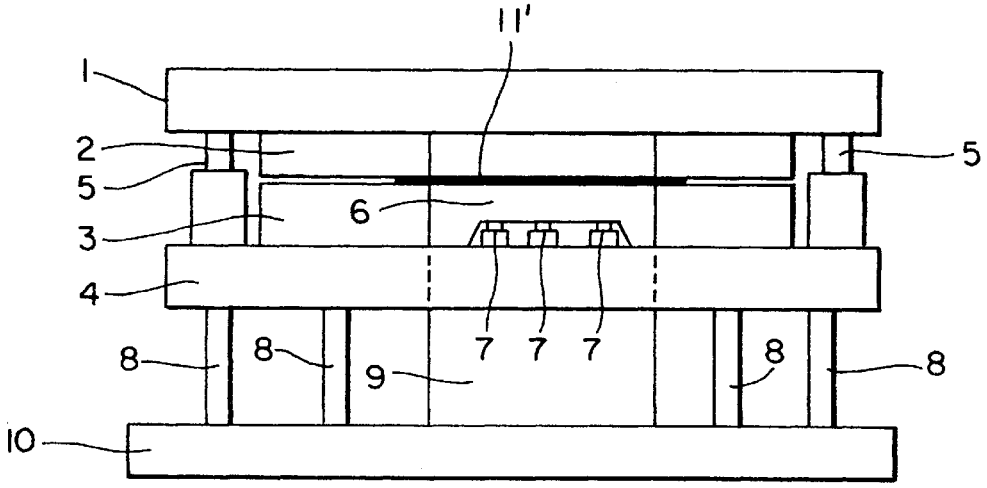
FIG. 2 represents the same press closed at the end of stamping.

In FIG. 1, the reference number 1 denotes the movable ram of a stamping press, the number 2 denotes the die fixed to the ram, the die having in hollow form the shape of the component to be stamped, the number 3 denotes the blank holder and the number 4 denotes a component for supporting the blank holder, which component 4 bears directly or indirectly, for example by means of columns 8 through the table 10, on the cushion of the press. For simplicity, this component 4 will hereinafter be referred to by the term "cushion". In this arrangement, the punch 9 is stationary and rests on the table 10 of the press, passing through the opening in the blank holder 3. The sheet to be stamped is denoted by the number 11. In FIG. 2, the sheet 11 is converted into the stamped component 11' as a consequence of the movement, in the direction of the arrow F, of the ram 1 and the die 2 which rests on top of the punch 9.

In accordance with the invention, compensating cylinders 5 are provided which rest directly or indirectly on the press cushion 4 and exert their force on the ram 1. Alternatively, the compensating cylinders 5 may be fixed to the ram 1 and exert their force on the press cushion 4. The aforementioned compensating cylinders are squat cylinders whose working stroke, according to the very principle of the invention, is limited to a few millimetres, or even to a few tenths of a millimetre. These compensating cylinders are distributed around the perimeter of the blank holder, the distribution being defined by space or load-distribution considerations. The function of these compensating cylinders is to counter-balance and, where appropriate, to compensate for the force variations arising from the blank-holder pressure-regulating areas. These compensating cylinders may be hydraulically connected all together or this connection may be made in certain areas—in this case, there are various groups of compensating cylinders distributed around the periphery of the blank holder depending on blank-holder pressure distribution considerations in the conventional blank-holder areas.

During the movement of the ram 1, the ram 1 firstly comes into contact with the compensating cylinders 5, then immediately afterwards the die 2 comes into contact with the sheet 11. This initiates the movement of the press cushion 4 which thus moves and exerts a resisting force A. Integrated into the blank holder 3 are one or more areas 6 where the blank-holder pressure may be varied or regulated by means of small squat cylinders 7 having a short working stroke, these being connected to one or more servovalves (depending on whether there are one or more blank-holder pressure-regulating areas), as described in EP-B-0,475,923. The control point of these servovalves is either predetermined before the stamping operation or generated from significant parameters of the stamping process, such as punch force measurements, wrinkle detection measurements and measurements of the movement of the stamped sheet, this being accomplished using a control logic of the PID type for example. In other words, the pressure control signal is determined from at least one measurement signal generated by at least one measurement sensor and representing at least one stamping process parameter influenced by the blank-holder force, which control signal is determined using a closed-loop control principle so as to control the variation in this parameter in a defined way before the stamping operation.

In the aforementioned areas 6 (bounded by the axis lines in FIG. 1) the geometry or the construction of the blank holder may be modified (the thickness may, for example, be reduced as indicated in FIG. 1) so as to obtain good distribution of the pressure on the stamped sheet 11 in this area, this pressure being determined by the cylinders 7, while in the conventional blank-holder areas the blank holder rests directly on the cushion 4, which transfers to it the force determining the blank-holder pressure in these areas.

The pressure developed in the compensating cylinders 5 is generated by one or more servovalves depending on whether they are grouped together in one or more areas, according to the required pressure distribution in the conventional blank-holder area; the pressure control signal given to this or these servovalves is designed so as to compensate for the force variations generated in the blank-holder pressure-regulating areas in order to keep the blank-holder pressure in the conventional blank-holder area constant.

Figure 3:
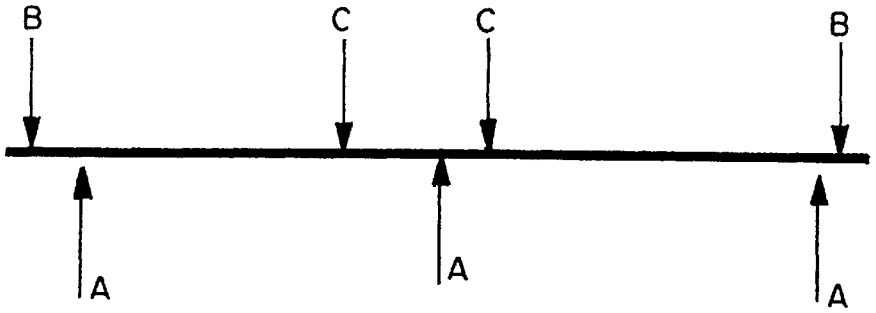
FIG. 3 is a diagram indicating the forces involved in the process according to the invention.

FIG. 3 shows the diagram of the resulting forces involved on the blank holder. The force A developed by the press cushion 4, which is constant or almost constant during the stamping operation, is partially counterbalanced by two opposing forces—the total force B resulting from the pressures in the conventional blank-holder pressure-regulating area or areas resulting from the various compensating cylinders (5), and the total force C resulting from the pressures in the areas (6) resulting from the various squat compensating cylinders (7). The residual value, i.e. the difference between the force A and the sum of the total forces B and C, is therefore applied to the conventional blank-holder area. In order to obtain a constant blank-holder pressure in this area, all that is required is for the sum of the compensating forces B and C to be constant—the force applied to the conventional blank-holder area is the difference between the force A exerted by the press cushion and this sum B+C.

The pressure developed in the compensating cylinders is generated by one or more servovalves, depending on whether there are one or more areas of compensating cylinders; the pressure control signal given to this or these servovalves is therefore calculated by the computer, depending on the total value of the forces B, so that the total value of the compensating forces C is such that the sum s+C is constant. When there are several areas of compensating cylinders, the pressure may be different in each area, according to considerations of blank-holder pressure balancing in the conventional blank-holder area, but the total value of the compensating forces C must satisfy the abovementioned criterion.

In an alternative embodiment, the compensating force C may be defined in such a way that the sum B+C is not constant, but varies—thus a variable blank-holder pressure in the conventional blank-holder area is also obtained. The advantage here is an economic one—when the blank-holder pressure can be varied uniformly over a wide area of the tool it is more economic to use compensating cylinders rather than cylinders distributed in the tooling.

Figure 4:
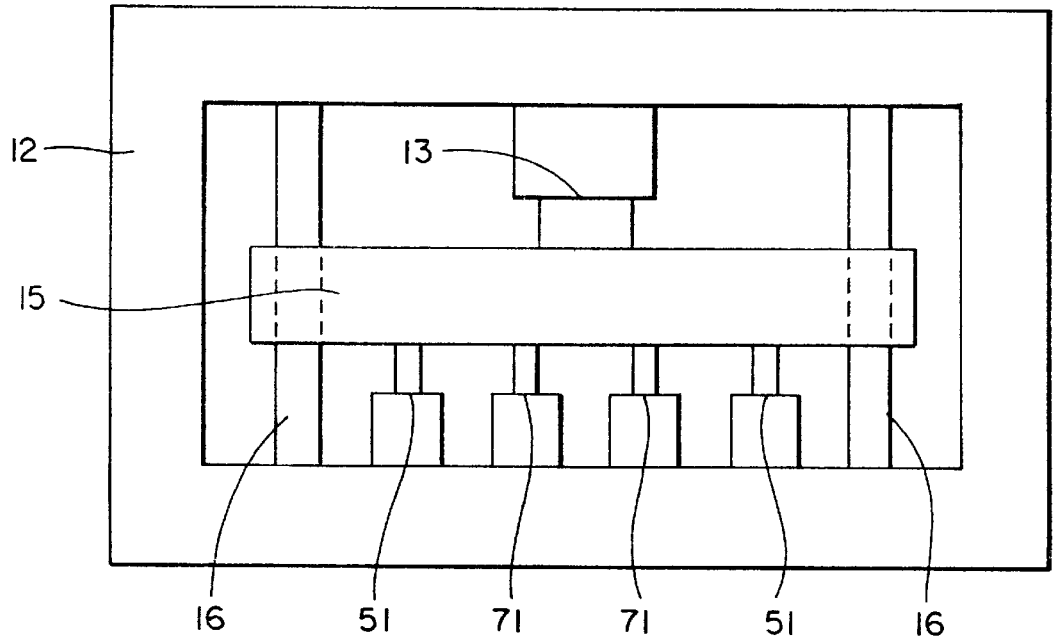
FIGS. 4, 5 and 6 show alternative illustrative embodiments of the invention.

In another particular embodiment, the compensating pressure may be produced by a hydraulic device which automatically generates the compensating pressure through the agency of opposing cylinders. The principle of such a system is shown in FIG. 4. Various cylinders are mounted in a frame 12, this being independent of the press. A cylinder 13 bears on a plate 15, which is guided by columns 16 fixed to the frame and is limited in terms of stroke by limit stops (not shown). The plate 15 bears on at least two groups of cylinders. A first set of cylinders referenced 71 is composed of groups of cylinders hydraulically connected to the various servovalves generating the pressure variations in the blank-holder pressure-regulating areas 6—there is at least one cylinder per servovalve, each cylinder being connected to only one servovalve. The cylinder or cylinders connected to a servovalve constitute a group of cylinders. A second group of cylinders referenced 51 is composed of cylinders connected to the compensating cylinders 5. The ratio of the total cross-section of each area of cylinders of the device to the total cross-section of the corresponding cylinders in the press is identical. Thus, if S1 represents the total cross-section of the cylinders 51 of the device, if S2 represents the total cross-section of the compensating cylinders of the tool, if S3i represents the total cross-section of a group of cylinders 71 connected to the servovalve i and if S4i represents the total cross-section of the cylinders connected to the same servovalve in the tool, then S1/S2=S3i/S4i.

The force exerted by the cylinder 13 on the plate 15 is chosen to be always greater than the total, force which will be exerted by the cylinders 71 receiving their pressure from the servovalves. Under this condition, it is chosen depending on the force A of the cushion 4 and on the blank-holder pressure which it is desired to obtain in the conventional blank-holder area. The system thus automatically generates the compensating pressure. The stroke of the various cylinders in the hydraulic device must be sufficient to generate a stroke of the compensating cylinders which guarantees that the forces are applied effectively. The blank-holder force in the conventional blank-holder area may also be made to vary, by varying the force FT during the stamping operation, for example by means of a servovalve.

In an another alternative embodiment, the compensating cylinders 5 are used by themselves (there are no variable-pressure areas 6 in the blank holder, nor any cylinders 7) and therefore simply allow the blank-holder force in the conventional blank-holder area to vary. Given the squatness of the compensating cylinders, good dynamic performance in terms of force variation can be achieved. The compensating cylinders are distributed around the periphery of the tool so as to obtain suitable distribution of blank-holder pressure.

Figure 5:
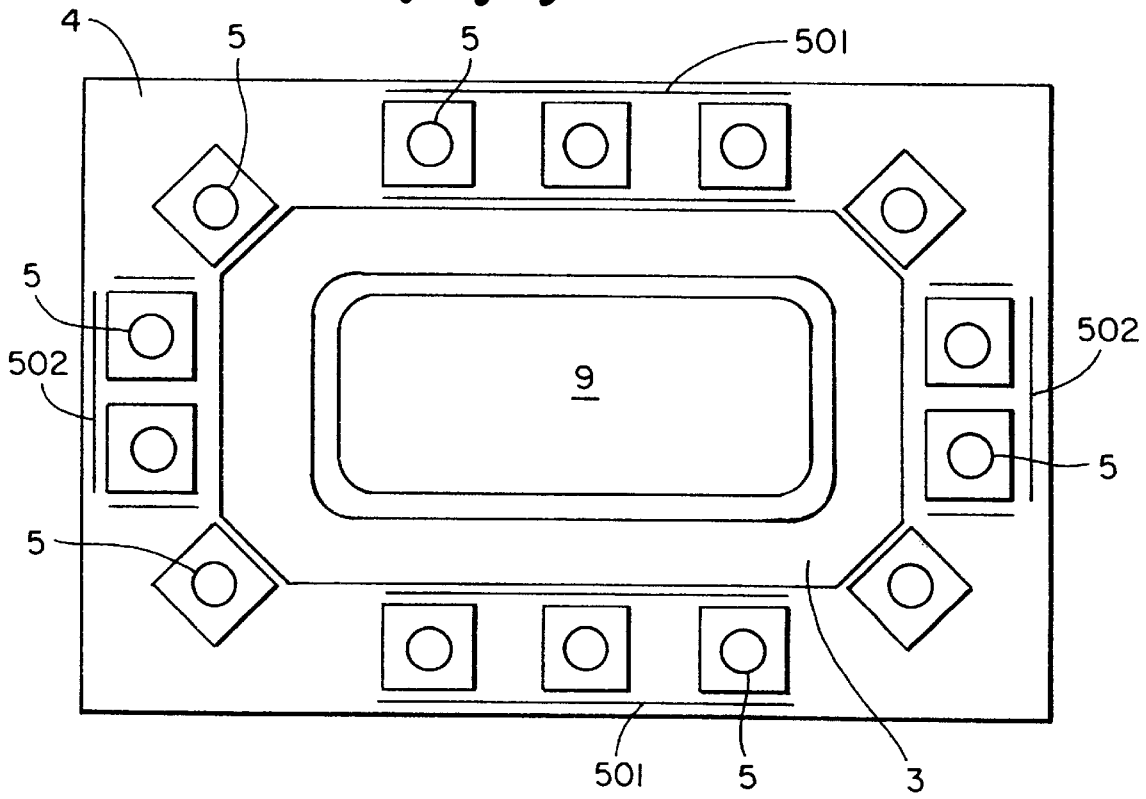

This alternative embodiment may be optimized by using several areas of compensating cylinders, these areas being distributed depending on the geometry of the component to be stamped. FIG. 5 illustrates the case of a stamping of the rectangular type and shows a top view of the blank holder and of the cushion with an example of one way of distributing the compensating cylinders. Two areas 501 of compensating cylinders 5 corresponding to the long sides—the compensating cylinders belonging to these areas are hydraulically connected—and two areas 502 of compensating cylinders 5 corresponding to the short sides, where the cylinders 5 are also hydraulically connected, may thus be distinguished; the four remaining cylinders 5 correspond to the corners of the component and are also hydraulically connected. These three groups of cylinders 5 are connected to an element allowing the fluid pressure within the cylinders to be controlled, for example a servovalve. In this case, there are therefore three servovalves. The pressure in these areas of compensating cylinders is then regulated according to the principles defined in European Patent No. 0,475,923, that is to say that the pressure control point is determined from at least one measurement signal generated by at least one measurement sensor and representing at least one stamping process parameter influenced by the blank-holder force, which control signal is determined using a closed-loop control principle so as to control the variation in this parameter in a defined way before the stamping operation. In this case, the pressure variations in those areas of the blank holder 3 which are adjacent to the areas 501 and 502 of compensating cylinders 5 (corner areas) are therefore obtained indirectly by acting on the elastic flexure of the blank-holder and die elements—the greater the force developed by the compensating cylinders, the smaller is the force, in the area in question, which is transferred directly by the cushion 4 through contact between the blank holder 3, the stamped sheet 11 and the die 2. The advantage is that the construction of the tool is simplified.

Figure 6:
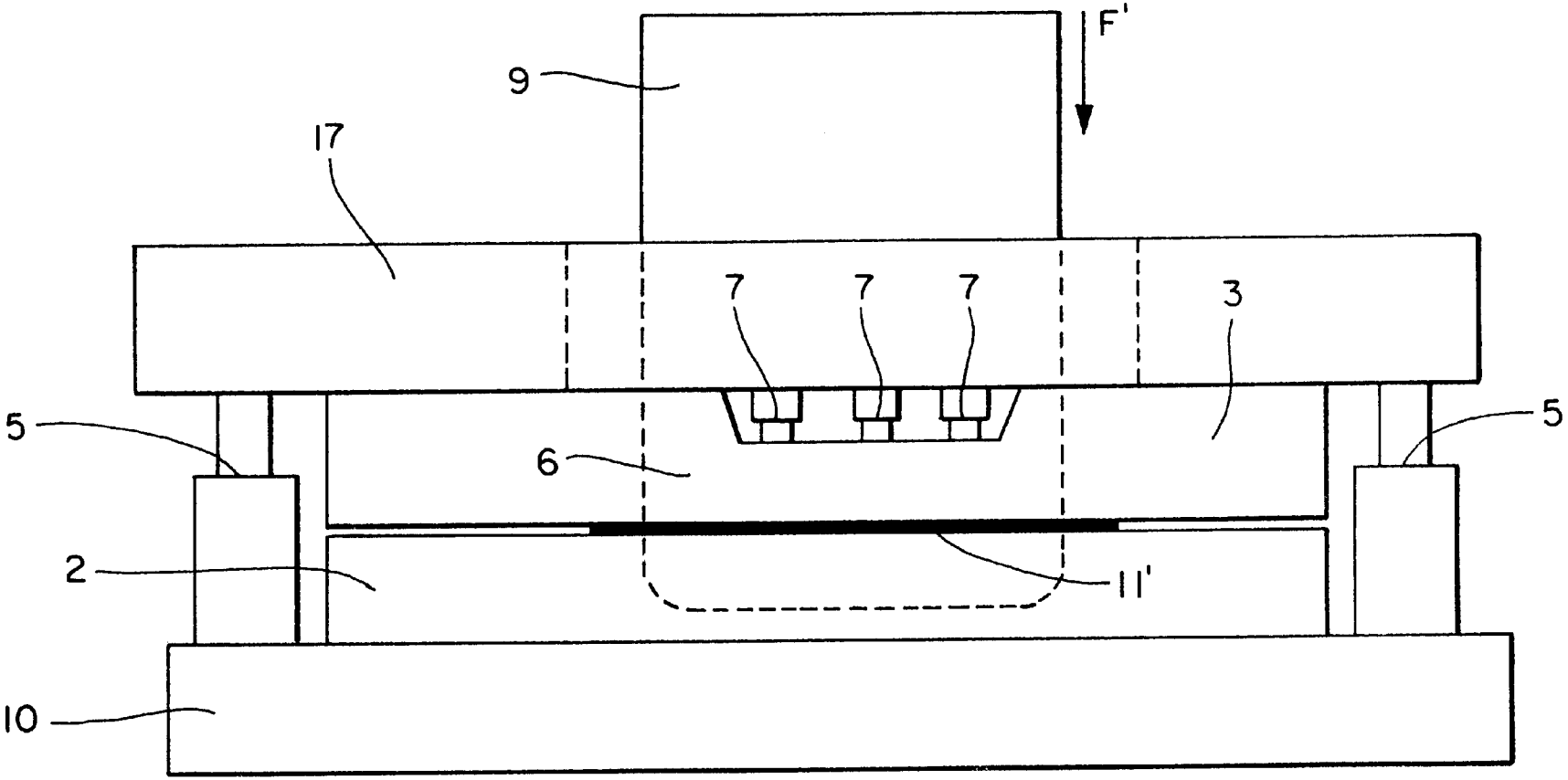

In the foregoing, the invention was described in the case in which the blank holder rests directly on the press cushion (see FIGS. 1 and 2), However, it is clear that the same considerations may apply in the reverse arrangement and that, as shown in FIG. 6, the blank holder 3 is mounted above the die 4 and actuated by movement of a ram 17 of the press. In this case, the punch 9 is also carried by the movable ram and is made to move, and exert its force, in the direction of the arrow F'.

I claim:

1. Stamping press comprising a ram (1) mounted so as to move relative to the cushion (4) of the press, a die (2) being fixed to the ram and able to press a sheet (11) resting on a blank holder (3), the blank holder resting on the cushion, the press being characterised in that one or more fluid-operated compensating cylinders (5) are distributed around the blank holder (3), the said compensating cylinders resting on the cushion (4) and are provided to exert their force against the ram (1) of the press, in that the compensating cylinders (5) come into contact with the ram (1) before the die touches the sheet (11) during the descent of the ram (1) and in that the compensating cylinders receive a pressurized fluid from at least one control valve which receives a pressure control signal so that the total force (B) developed by the compensating cylinders (5) varies during the stamping operation while always remaining at the most equal to the force (A) exerted by the cushion (4) so that the blank-holder force which is applied to the sheet (11) between the die and the blank holder and which is equal to the difference between the forces (A) and (B) varies during stamping, even if the force (A) exerted by the cushion is constant.

2. Stamping press according to claim 1, characterised in that the blank holder comprises one or more first areas (6) in which the local blank-holder pressure is obtained by means of at least one squat fluid-operated cylinder (7) exerting its force on the said blank holder and bearing on the cushion (4), the said squat cylinder (7) receiving a pressurized fluid so as to vary or regulate the force exerted by the blank holder (3) in the corresponding first area, the compensating cylinders (5) being used to control the pressure in second areas of the blank holder, where second areas are those areas not corresponding to the first areas (6), the total force exerted on these first and second areas then being equal to the difference between the force (A) exerted by the cushion and the sum of the force (B) exerted by the compensating cylinders (5) and the force (C) exerted by the set of squat cylinders (7).

3. Stamping press according to claim 2, characterised in that at least one of the squat fluid-operated cylinders (7) in at least one first area (6) receives pressure from at least one valve, the pressure control point of which is determined from at least one measurement signal generated by at least one measurement sensor and representing at least one stamping process parameter influenced by the blank-holder force (D), which control point is determined using a closed-loop control principle so as to control the variation in this parameter in a defined way before the stamping operation.

4. Stamping press according to claim 2, characterised in that the compensating cylinders (5) receive their pressure from at least one valve, the pressure control signal of this valve being determined from the measurement of the pressure in the compensating cylinders (5) and in the squat cylinders (7) so that the sum of the forces (B) exerted by the compensating cylinders (5) and the forces (C) exerted by the squat cylinders (7) is constant.

5. Stamping press according to claim 2, characterised in that the pressure in the compensating cylinders is obtained with the aid of a fluid-operated device comprising at least one device cylinder (13) which exerts a constant force (E) on a moveable plate (15) acting on at least two groups of cylinders (51, 71), the first group of said at least two groups is hydraulically connected to the compensating cylinders (5), the second group of said at least two groups being connected to the squat cylinders (7) in the aforementioned first areas (6) working at the same pressure being connected only to one of said second group of cylinders (71), the ratios of the total cross section (S1) of the first group of cylinders (51) to the total cross section (S2) of the compensating cylinders (5) and the ratios of the total cross sections (S3I) of the second group of cylinders (71) of each area (i) working at the same pressure to the total cross sections (S4I) of the corresponding squat cylinders (7) being equal, the force (E) exerted by the device cylinder (13) being greater than the total value of the forces exerted by the second group of cylinders (71) which receive their pressure from the valves determining the pressure in the first areas (6) of squat cylinders (7).

6. Stamping press according to claim 5, characterised in that the force exerted by the device cylinder (13) is not constant, but varies while still always remaining greater than the total force exerted by the second group of cylinders (71).

7. Stamping press according to claim 6, characterised in that the variations in the force exerted by the device cylinder (13) are predetermined before stamping.

8. Stamping press according to claim 6, characterised in that the force exerted by the device cylinder (13) varies according to a closed loop control principle based on a measurement of at least one stamping process parameter influenced by a force exerted by the blank holder.

9. Stamping press according to claim 1, characterised in that the compensating cylinders (5) are grouped together and hydraulically connected in various areas associated with regions of the stamped component, these areas being each connected to a valve which controls the fluid pressure in the cylinders making up these areas.

10. Stamping press according to claim 1, characterised in that at least one of the compensating cylinders (5) receives pressure from at least one valve, the pressure control signal of which is determined from at least one measurement signal generated by at least one measurement sensor and representing at least one stamping process parameter influenced by the blank-holder force (D), which control signal is determined using a closed-loop control principle so as to control the variation in this parameter in a defined way before the stamping operation.

11. Stamping press according to claim 1, characterised in that the pressure in at least one of the valves is defined by a pressure control point determined from at least one measurement signal generated by at least one measurement sensor and representing at least one stamping process parameter influenced by the blank-holder force, which control point is determined using a closed-loop control principle so as to control the variation in this parameter in a defined way before the stamping operation.

12. Stamping press according to claim 1, characterised in that the blank holder (3) rests directly on the cushion of the press.

13. Stamping press according to claim 1, characterised in that the blank holder (3) is mounted on a blank-holder ram (17) of the press, the die (2) rests on the table (10) of the press the punch (9) is set into movement by a ram of the press.

14. Stamping press according to claim 1, characterised in that the pressure control point or points are calculated continuously by a processor.

* * * * *